US007123200B1

(12) United States Patent
Smith et al.

(10) Patent No.: US 7,123,200 B1
(45) Date of Patent: Oct. 17, 2006

(54) SEA SURFACE ANTENNA

(75) Inventors: Martin Stevens Smith, Chelmsford (GB); David Neil Adams, London (GB)

(73) Assignee: Nortel Networks Limited, Berkshire (GB)

( * ) Notice: Subject to any disclaimer, the term of this patent is extended or adjusted under 35 U.S.C. 154(b) by 0 days.

(21) Appl. No.: 07/702,463

(22) Filed: May 2, 1991

(30) Foreign Application Priority Data

May 2, 1990 (GB) ..... 9009871.6

(51) Int. Cl.
*H01Q 1/34* (2006.01)
*H01Q 13/10* (2006.01)

(52) U.S. Cl. ..... 343/709; 343/767; 343/768

(58) Field of Classification Search ..... 343/709, 343/767, 768
See application file for complete search history.

(56) References Cited

U.S. PATENT DOCUMENTS 2,762,044 A * 9/1956 Boys et al. ..... 343/767
4,086,598 A * 4/1978 Bogner ..... 343/768
4,367,475 A * 1/1983 Schiavone ..... 343/767
4,639,227 A * 1/1987 Rademakers ..... 343/709

FOREIGN PATENT DOCUMENTS

GB 2165396 A * 1/1986

OTHER PUBLICATIONS

Smith et al, "A UHF Buoyant Antenna" International Conference on Antennas and Propagation (ICAP 87), Apr. 1987, p. 273-276.*

* cited by examiner

*Primary Examiner*—Gregory C. Issing
(74) *Attorney, Agent, or Firm*—Miles & Stockbridge P.C.

(57) ABSTRACT

A sea surface antenna comprises a cylindrical tube of metallic material 13 on a dielectric former. The tube has a longitudinal slot shorted at each end and coupled at its midpoint to a coaxial feed. The slot is bridged by two groups of capacitances each group being distributed along a respective half of the slot. The length of the antenna is less than 0.25 λ and the diameter of the antenna is less than 0.02 λ, where λ is the free space wavelength at the operating frequency. The antenna is dimensioned so as to operate in an evanescent mode at a resonant frequency less than the cut-off frequency.

5 Claims, 1 Drawing Sheet

SEA SURFACE ANTENNA

This invention relates to a sea surface antenna which can be towed behind a marine craft for radio communication purposes.

BACKGROUND OF THE INVENTION

A so-called buoyant antenna is disclosed in the paper "A Slender Resonator—Slot Antenna" by J. C. Lee, IEE International Conference on Antennas and Propagation, Conf. Publ. No. 195, pp 442–446, 1981. Essentially the antenna disclosed comprises a slot formed by the edge opening in a roll-resonator of copper clad plastic dielectric, approximately ½ free-space wavelength long. The slot is short circuited at the two ends, and the antenna is fed by a coaxial line the inner and outer conductors of which are soldered to respective sides of the slot. A modified antenna is disclosed in "UHF Buoyant Antenna" by M. S. Smith et al, IEE ICAP 87, pp 1.273–1.276, 1987. The modified antenna augments the "per unit length" capacitance by discrete capacitors connected across the slot, the length of the antenna being approximately equal to $\lambda/2$, where $\lambda$ is the free space wavelength at the operating frequency of the antenna. The practical design disclosed in FIG. 1(*b*) of the paper comprises a cylindrical tube of metallic material on a dielectric former having a longitudinal slot which is shorted at each end and coupled to a coaxial feed at its center, the slot being bridged by two capacitances respectively positioned approximately midway between the center feed and the shorted ends. The antenna length is approximately $\lambda/2$ and operates in a weakly evanescent mode. However, there are applications in which a buoyant antenna is required which is limited to smaller dimensions imposed by physical constraints in its operating environment.

SUMMARY OF THE INVENTION

According to the present invention there is provided a sea surface antenna comprising a tube of metallic material, the tube having a substantially longitudinal slot coupled at or near its midpoint to a feed line, the slot being bridged by two pluralities of capacitances to either side of the feedpoint, each plurality being distributed along a respective part of the slot, the antenna being dimensioned so as to operate in an evanescent mode at a resonant frequency less than the cut-off frequency.

BRIEF DESCRIPTION OF THE DRAWINGS

Embodiments of the invention will now be described with reference to the accompanying drawings, in which.

DESCRIPTION OF THE PREFERRED EMBODIMENTS

Figure 1:
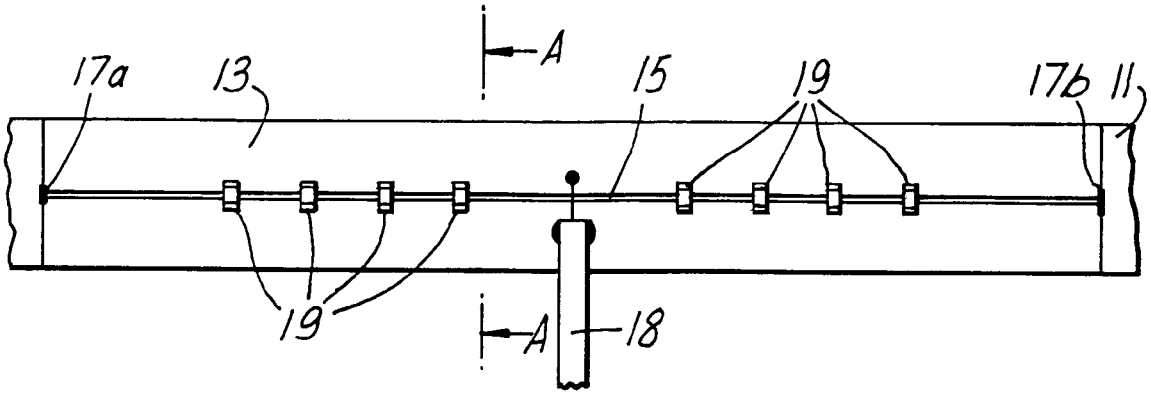
FIG. 1 is a schematic illustration of a buoyant antenna.
Figure 2:
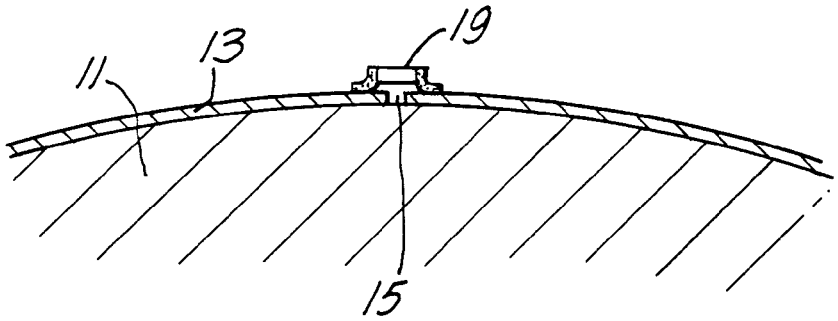
FIG. 2 is a part sectional detail of the antenna taken on the line A—A of FIG. 1.

The antenna shown in the drawings comprises a rigid cylindrical dielectric former 11 having a cladding of copper 13. A narrow longitudinal slot 15 is machined in the copper cladding. The ends 17*a*, 17*b* of the slot 15 are shorted and across the midpoint of the slot are soldered the two conductors of a coaxial cable 18 that feeds the antenna. A number of discrete capacitors 19 are mounted across the slot along its length in two equal groups in a configuration that is symmetrical about the feed point.

The exact symmetry described is not essential but is a convenient design feature.

It is important to note that the capacitors do not simply tune and match the antenna input impedance, but that they also modify the voltage distribution along the radiating slot. The feature is used to combat the evanescent nature of the antenna and to produce an effective length substantially greater than if the capacitors were not present, and hence to improve the antenna efficiency.

When a signal is applied to the center of the slot an electric field is formed across it, spreading along its length in both directions and falling to zero at its ends. This field radiates a linearly polarised pattern with an electric field orthogonal to the line of the slot. In practice the antenna would be deployed on the sea surface which would form a lossy ground plane. The degree of loss would be angle dependent. The peak gain value of the radiation from the slot can be obtained from the distribution of the electric field along the slot.

By varying the value of the capacitors mounted across the slot the resonant frequency of the antenna is changed. The use of suitable varactor diodes with suitable variable bias means would give an antenna that could be tuned to any point within a given band. As varactors tend to have lower Q than fixed capacitors the loss will be greater. However, by using as few varactors as possible this loss can be kept to a minimum.

An experimental antenna operating at a resonant frequency of 261.0 MHz in an evanescent mode has been produced. The length of the antenna is approximately 22 cm, i.e. approximately 0.2 $\lambda$, and its diameter is approximately 1.5 cm, i.e. approximately 0.013 $\lambda$. Due to its short physical length such an antenna has a broad hemispherical radiating pattern. The antenna has a gain of −6.0 dBi and a 3 dB bandwidth of 6.1 MHz.

When two such short length evanescent mode antennas are placed in a close colinear configuration and connected electrically in parallel the observed radiation efficiency is approximately twice that of a single antenna.

Whilst one particular construction of antenna has been described, variations in the construction can be adapted. For example, the antenna can be constructed from a rigid self-supporting metal tube, not necessary cylindrical in section, without the need for a rigid dielectric former. The slot need not be a straight longitudinal slot but can be sinuous. If a hollow metal tube is employed it may be possible to locate the capacitor bridging the slot on the inside of the tube, thus allowing a smooth external profile to be achieved. Likewise the co-axial feed can be connected internally. To achieve the required buoyancy the antenna can rely on the buoyancy of the feed cable to which it is attached or, if a rigid hollow tube is used and it is enclosed in a hermetically sealing external protective covering, e.g of plastics material, then buoyancy can be provided by gaseous content of the hollow tube.

The invention claimed is:

1. A sea surface antenna comprising a tube of metallic material, the tube having a substantially longitudinal slot coupled at its midpoint to a feed line, the slot being bridged by two pluralities of varactor diodes to either side of the feed-point, each plurality being distributed along a respective part of the slot, the length of the antenna being less than 0.25 $\lambda$, where $\lambda$ is the free space wavelength at the operating frequency, the antenna being dimensioned so as to operate in an evanescent mode at a resonant frequency less than the cut-off frequency, the antenna being provided with means for applying a variable bias to the varactor diodes.

2. An antenna according to claim 1 wherein the slot is shorted at each end.

3. A sea surface antenna comprising a tube of metallic material on a dielectric former, the tube having a longitudinal slot coupled at its midpoint to a feed line, the slot being bridged by two pluralities of varactor diodes to either side of the feed-point, each plurality being distributed along a respective part of the slot, the length of the antenna being less than 0.25 λ and the diameter of the antenna being less than 0.02 λ, where λ is the free space wavelength at the operating frequency, the antenna being dimensioned so as to operate in an evanescent mode at a resonant frequency less than the cut-off frequency, the antenna being provided with means for applying a variable bias to the varactor diodes.

4. An antenna according to claim 3 wherein the slot is shorted at each end.

5. A sea surface antenna arrangement including two or more like antennas placed in a colinear configuration and connected electrically in parallel, wherein each of said like antennas comprises a tube of metallic material on a dielectric former, the tube having a substantially longitudinal slot coupled at its midpoint to a feed line, the slot being bridged by two pluralities of varactor diodes to either side of the feed-point, each plurality being distributed along a respective part of the slot, the length of the antenna being less than 0.25 λ and the diameter of the antenna being less than 0.02 λ, where λ is the free space wavelength at the operating frequency, the antenna being dimensioned so as to operate in an evanescent mode at a resonant frequency less than the cut-off frequency, the antenna being provided with means for applying a variable bias to the varactor diodes.

* * * * *